US006041602A

United States Patent [19]

Dickey

[11] Patent Number: 6,041,602

[45] Date of Patent: Mar. 28, 2000

[54] HYDRAULICALLY-ACTUATED EXHAUST GAS RECIRCULATION SYSTEM AND TURBOCHARGER FOR ENGINES

[75] Inventor: Daniel W. Dickey, Helotes, Tex.

[73] Assignee: Southwest Research Institute, San Antonio, Tex.

[21] Appl. No.: 08/871,205

[22] Filed: Jun. 9, 1997

[51] Int. Cl.[7] ..... F02M 25/07

[52] U.S. Cl. ..... 60/605.2

[58] Field of Search ..... 60/605.2, 607, 60/608, 609; 123/568.12, 568.21, 568.23

[56] References Cited

U.S. PATENT DOCUMENTS

| | | | |
|---|---|---|---|
| 3,869,866 | 3/1975 | Timoney | 60/607 |
| 4,231,225 | 11/1980 | Aya | 60/605.2 |
| 4,478,043 | 10/1984 | Kobavashi et al. | 60/608 |
| 4,622,817 | 11/1986 | Kobayashi | 60/608 |
| 5,375,419 | 12/1994 | Wright et al. | 60/607 |
| 5,657,630 | 8/1997 | Kjemtrup et al. | 60/605.2 |
| 5,771,868 | 6/1998 | Khair | 60/605.2 |
| 5,791,146 | 8/1998 | Dungner | 60/605.2 |

FOREIGN PATENT DOCUMENTS

| | | | |
|---|---|---|---|
| 4312462 | 10/1994 | Germany | 60/605.2 |
| 116232 | 5/1989 | Japan | 60/605.2 |
| 50433 | 2/1992 | Japan | 60/605.2 |
| 71426 | 3/1993 | Japan | 60/605.2 |
| 941532 | 11/1963 | United Kingdom | 60/605.2 |

*Primary Examiner*—Willis R. Wolfe
*Attorney, Agent, or Firm*—Jenkens & Gilchrist

[57] ABSTRACT

An exhaust gas recirculation pump is used to pump exhaust gas from an exhaust manifold to the intake manifold of an engine. The recirculation pump is hydraulically actuated. The compressor stage of a turbocharger is hydraulically assisted by a hydraulically-driven turbine mechanically connected to the turbocharger compressor stage to provide additional compressed intake airflow during transient engine conditions or during periods when the engine provides low exhaust energy to the gas-driven turbine section of the turbocharger.

13 Claims, 2 Drawing Sheets

HYDRAULICALLY-ACTUATED EXHAUST GAS RECIRCULATION SYSTEM AND TURBOCHARGER FOR ENGINES

BACKGROUND OF THE INVENTION

1. Technical Field

This invention relates generally to exhaust gas recirculation systems for internal combustion engines, and more particularly to a hydraulically-actuated exhaust gas recirculation pump in conjunction with a hydraulically-assisted turbocharger for an engine.

2. Background Art

It is desirable to recirculate the exhaust gas of internal combustion engines, and particularly heavy-duty diesel engines, to reduce undesirable $NO_x$ emissions without increasing particulate material (PM) emissions. However, in turbocharged engines, there is an adverse pressure gradient between the exhaust and intake manifold so that some means is required to pump and control exhaust gas recirculation (EGR) flow. In particular, in heavy-duty diesel engines, EGR reduces engine air/fuel ratio (A/F) which increases particulate formation under some operating conditions. For example under peak torque conditions, it is desirable to increase the A/F when using EGR to improve the $NO_x$-PM trade-off. Also, it is important that engine emissions be controlled during transient conditions. Transient conditions exist when an engine moves from one load state to another. For example, an "up transient" occurs when an engine moves from a low load (relatively high A/F) to a higher load (lower A/F) condition. Engine speed may also change during a transient. Additionally, there is generally a deterioration of transient performance in any engine having exhaust gas recirculation (EGR). Adding energy to the turbocharger during transients reduces smoke and particulate emissions.

Therefore, there are three main problems with using exhaust gas recirculation in general, and in turbocharged heavy-duty diesel engines in particular. First, a method must be provided to drive, or pump, the recirculated exhaust gas from the exhaust manifold to the intake manifold of the engine. Secondly, additional air should be provided under some EGR conditions, such as peak torque, to improve the $NO_x$-PM trade-off. Thirdly, a method of overcoming the deterioration of transient performance of the engine must be provided. Additional air should be added during up transients to clear the EGR from the intake system and increase the A/F to reduce smoke and particulates.

Several arrangements have been proposed for providing an hydraulic assist to a conventional turbocharger for the purpose of improving transient performance of an engine. For example, U.S. Pat. No. 3,869,866 issued Mar. 11, 1975 to Seamus G. Timoney, describes an internal combustion engine having a hydraulically-assisted turbocharger. However, there has heretofore been no system provided which works in conjunction with an auxiliary-boosted turbocharger to pump a portion of the exhaust gas discharged from the turbocharger turbine exhaust port or exhaust manifold into the intake manifold of the engine.

The present invention is directed to overcoming the problems set forth above. It is desirable to have an exhaust gas recirculation system suitable for use in a turbocharged engine. It is also desirable to have such an exhaust gas recirculation system that, in conjunction with a hydraulically-assisted turbocharger, improves the transient performance of an engine, and the performance under EGR conditions where the A/F is low due to EGR.

BRIEF SUMMARY OF THE INVENTION

In accordance with one aspect of the present invention, an exhaust gas recirculation system for an engine includes a hydraulically-driven EGR pump having a compressor which pumps engine exhaust gas from an exhaust manifold of the engine to the engine intake manifold. The exhaust gas recirculation pump is driven by pressurized hydraulic fluid directed through a turbine mechanically connected to the compressor of the pump.

Other features of the exhaust gas recirculation pump, embodying the present invention, include a heat exchanger positioned in fluid communication with the compressor of the EGR pump. Still other features include a gas flow control valve disposed in a passageway communicating the compressor stage of the EGR pump with the intake manifold of the engine, at least one sensor adapted to measure an operational characteristic of the engine, and an electronic control unit in electrical communication with the gas flow control valve and the sensor. The electronic control unit is adapted to control the EGR pump and the opening and closing of the gas flow control valve in response to receiving predefined electrical signals from the sensor.

In accordance with another aspect of the present invention, an air intake, exhaust, and exhaust gas recirculation system for an engine includes a hydraulically-assisted turbocharger which has a second turbine stage on the shaft connecting a conventional gas-driven turbine with the turbocharger compressor stage. Pressurized hydraulic fluid is directed to the second turbine stage to provide additional driving power to the compressor stage of the turbocharger during transient periods, periods of low exhaust gas energy, or under EGR conditions. The air intake, exhaust and exhaust gas recirculation system also includes an exhaust gas recirculation pump having a compressor stage in fluid communication with the exhaust manifold and the intake manifold of the engine. The exhaust gas recirculation pump is adapted to draw exhaust gas from the exhaust manifold the turbocharger exhaust port, compress the drawn exhaust gas, and discharge the compressed exhaust gas into a passageway communicating the EGR pump compressor stage with the intake manifold of the engine. The compressor stage of the exhaust gas recirculation pump is driven by a hydraulically-actuated turbine that is in fluid communication with a hydraulic pump.

Other features of the air intake, exhaust and exhaust gas recirculation system, embodying the present invention, include hydraulic fluid control valves that selectively and controllably direct a flow of pressurized hydraulic fluid to the second turbine of the turbocharger and the drive turbine for the EGR pump compressor stage. Other features include the hydraulic fluid control valves being controlled by an electronic control unit programmed to control the flow of pressurized fluid as a function of predetermined engine operating conditions.

BRIEF DESCRIPTION OF THE DRAWING

A more complete understanding of the structure and operation of the present invention may be had by reference to the following detailed description when taken in conjunction with the accompanying drawings, in which.

DETAILED DESCRIPTION OF THE INVENTION

Figure 1:
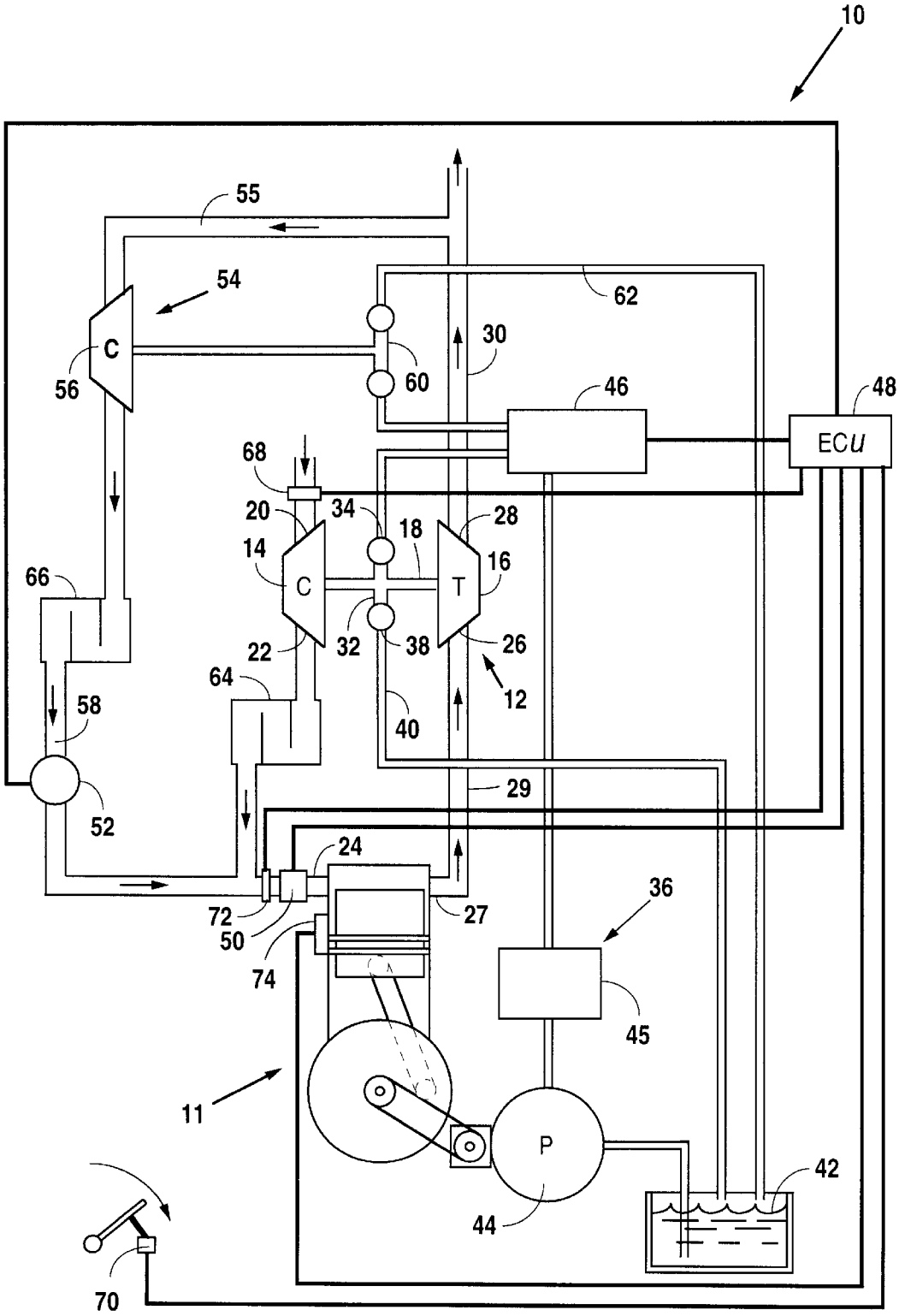
FIG. 1 is a schematic representation of a low pressure loop exhaust gas recirculation system for a turbocharged engine, embodying the present invention.
Figure 2:
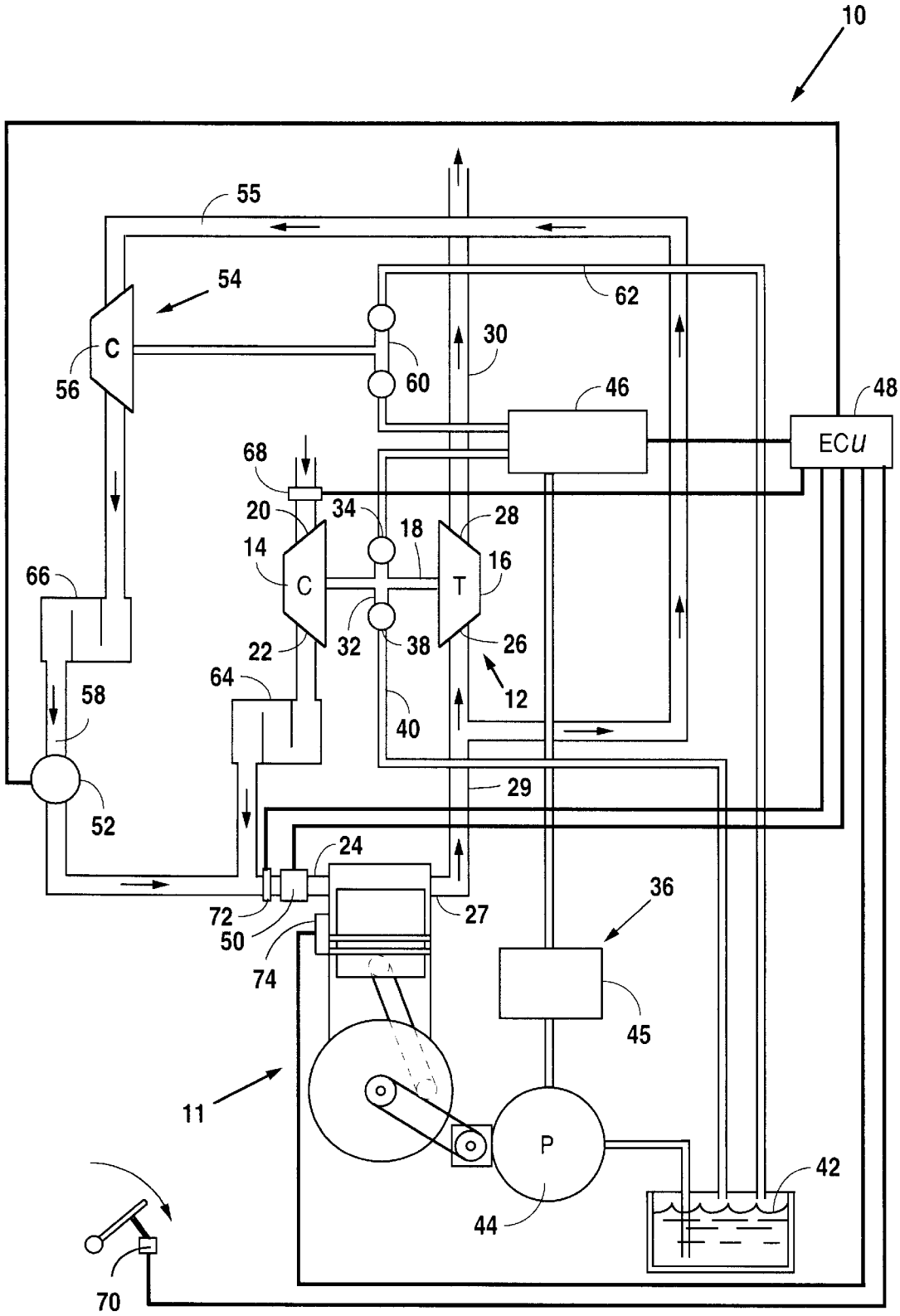
FIG. 2 is a schematic representation of a high pressure loop exhaust gas recirculation system for a turbocharged engine, embodying the present invention.

The hydraulically-actuated EGR system for turbocharged engines, embodying the present invention is suitable for use in either a low pressure loop EGR system, as illustrated in FIG. 1, or a high pressure loop EGR system, as shown in FIG. 2. In the low pressure loop EGR system, the intake to a hydraulically-actuated EGR pump 54 is in direct communication with an exhaust duct 30 of the turbocharger, whereas in the high pressure loop EGR system, the hydraulically-actuated EGR pump intake is in communication with the exhaust manifold 27 of an engine 11. While the EGR system embodying the present invention is suitable for use on turbocharged internal combustion engines, such as gasoline fueled, natural gas fueled, and diesel fueled engines, the system is particularly beneficial when applied to heavy duty diesel engines, and in the following preferred exemplary embodiments, will be described in association with a diesel engine.

In the first exemplary preferred embodiment of the present invention, as shown schematically in FIG. 1, an air intake, exhaust and exhaust gas recirculation system 10, for a heavy-duty diesel engine 11, includes a turbocharger 12 having a compressor stage 14 and a gas-driven turbine 16 mechanically connected via an interconnecting shaft 18 with the compressor stage 14 of the turbocharger 12. The compressor stage 14 has an air inlet port 20 in fluid communication with a source of intake air, and a discharge port 22 that is in fluid communication with an intake manifold 24 of the diesel engine 11. The turbocharger turbine 16 has an inlet port 26 in fluid communication with an exhaust manifold 27 of the engine 11, and a discharge port 28 in fluid communication with an exhaust duct 30.

In the preferred embodiment, the turbocharger 12 also includes a hydraulically-driven turbine 32 that is mounted on the shaft 18 and thus also mechanically connected to the compressor stage 14 of the turbocharger 12. The hydraulically-driven turbocharger turbine 32 has an inlet port 34 in fluid communication with a controlled source of pressurized fluid 36 and a discharge port 38 in fluid communication, via a return line 40, with a drain or storage reservoir 42.

In the present invention, the source of pressurized fluid 36 includes a hydraulic pump 44 that is arranged to draw fluid from the reservoir 42, compress the fluid, provide a supply of the pressurized fluid to an accumulator, or surge tank 45, and thence to a fluid flow control valve 46 which desirably has at least two separately controlled outlets. The operation of the fluid flow control valve 46 and preferably also the hydraulic pump 44, are controlled by an electronic control unit 48. The electronic control unit (ECU) 48 is advantageously a conventional programmable microprocessor unit of the type commonly used to control a plurality of engine operating characteristics, such as turbocharger boost and emission control. In the illustrative embodiments, the ECU 48 is in electrical communication with at least one sensor adapted to measure operational characteristics of the engine 11. For example, as illustrated in FIGS. 1 and 2, the sensors may comprise one or more, or all, of the following: a wide-ratio oxygen sensor 50 positioned in fluid communication with the intake manifold 24 of the engine 11; an ambient, or intake, air temperature sensor 68 disposed in communication with the inlet port 20; an accelerator pedal position sensor 70; manifold temperature and pressure sensors 72; an engine coolant temperature sensor 74, or other sensors, not specifically shown. The electronic control unit 48 is also electrically connected to the fluid flow control valve 46, the hydraulic pump 44, and an exhaust gas recirculation (EGR) flow control valve 52. The operation of the electronic control unit 48 and the respective valves and pump will be described below in additional detail.

Importantly, in both the low pressure loop EGR system, illustrated in FIG. 1, and in the high pressure loop system, shown in FIG. 2, the exhaust gas recirculation system 10, embodying the present invention, includes an exhaust gas recirculation pump 54 having a compressor stage 56. In the first exemplary preferred embodiment, illustrated in FIG. 1, the compressor stage 56 is in direct fluid communication with the exhaust duct 30 of the turbocharger 12 via a duct 55 extending between the inlet port of the compressor stage 56 and the exhaust duct 30. Thus, in this embodiment, the compressor stage 56 is in indirect communication with the exhaust manifold 27 of the engine 11, with the gas exhausted from the manifold 27 passing through the turbine section 16 of the turbocharger 12 before being introduced into the inlet port of the compressor stage 56. In this arrangement, some of the energy of the engine exhaust gas is used to drive the turbine 16, thereby reducing the pressure of the exhaust gas discharged from the turbine discharge port 28 into the exhaust duct 30 and subsequently delivered to the compressor stage 56 of the EGR pump 54.

In the second exemplary preferred embodiment, shown in FIG. 2, the compressor stage 56 is in direct fluid communication with the exhaust manifold 27 of the engine 11, via a duct 29 connecting the exhaust manifold 27 to the inlet port 26 the exhaust duct 30 of the turbocharger 12. In both exemplary systems, a high pressure flow of recirculated exhaust gas is discharged from the compressor stage 56 of EGR pump 54 via an interconnecting duct 58, to the inlet manifold 24 of the engine 11. Thus, the compressor stage 56 is adapted to draw exhaust gas from the turbine exhaust duct 30, or alternatively directly from the engine manifold 27, compress the drawn exhaust gas, and discharge the compressed gas through the interconnecting passageway 58 to the intake manifold 24 of the engine 11. Power for driving the compressor stage 56 of the exhaust gas recirculation pump 54 is provided by a hydraulically-driven vane-type turbine 60 that is mechanically connected by a shaft to the compressor stage 56. Desirably, the compressor stage 56 is a centrifugal compressor formed of steel, or other high temperature alloy, to withstand the high temperatures of the recirculated exhaust gas. The hydraulically-driven turbine 60 is in fluid communication with the source of pressurized fluid 36, and, via a return line 62, to the reservoir 42.

Desirably, a heat exchanger 64 is positioned between the discharge port 22 of the compressor stage 14 of the turbocharger 12 and the intake manifold 24 of the engine 11. Also, a heat exchanger 66 is desirably positioned between the compressor stage 56 of the exhaust gas recirculation pump 54 and the intake manifold 24 of the engine 11. Thus, the inlet air supply, heated as a result of the compression by the turbocharger 12, and the hot recirculated exhaust gas further heated as a result of compression by the recirculation pump 54, are both reduced in temperature prior to introduction into the intake manifold 24 of the engine 11.

In addition to the above-described sensors, the EGR system 10 embodying the present invention may also include separate pressure sensors, temperature sensors, or flow rate sensors, not shown, in the respective duct lines between the compressor stage 14 of the turbocharger 12 and the intake manifold 24, and between the compressor stage 56 of the recirculation pump 54 and the intake manifold 24. Such sensors may also be connected to the electronic control unit 48, along with the illustrated sensors, and used to control the operation of the fluid flow control valve 46, which desirably has separate valve sections to separately control the flow rate of pressurized hydraulic fluid to the turbine 32 of the turbocharger 12 and turbine 60 of the EGR pump 54, or both of the turbines 32, 60 simultaneously. Thus, the flow rate, and accordingly the pressure, of the recirculated exhaust gas delivered to the intake manifold 24, and the amount of assist provided to the compressor stage 14 of the turbocharger 12 may be independently or simultaneously controlled to provide a desired ratio mixture of intake air to recirculated exhaust gas at the intake manifold 24 of the engine 11.

Furthermore, the electronic control unit 48 is programmed to open or close the fast-acting valve 52 positioned between the EGR pump 54 and the intake manifold 24. Thus, the flow of recirculated exhaust gas may be quickly interrupted upon sensing an incipient transient condition of the engine and thereby provide a greater percent of intake air. Desirably, the valve 52 also provides a check against reverse flow to prevent inadvertent backflow through the EGR pump 54 in the event the turbocharged intake air pressure should be greater than the compressed recirculated exhaust gas pressure.

In some arrangements, it may be desirable to operate the hydraulic pump 44 on a continuous basis. For example, the hydraulic pump 44 may also provide pressurized hydraulic fluid or oil to other engine systems such as power steering, hydraulic suspension, or even engine lubrication. In such arrangements, it is desirable to provide a pressure relief valve, not shown, on the surge tank 45 so that excess hydraulic pressure can be diverted from the surge tank 45 back to the reservoir 42. Alternatively, the hydraulic pump 44 could be selectively engaged or disengaged from the engine 11, as required.

During steady-state operation, the hydraulic EGR pump 54 provides recirculated exhaust gas to the engine 11 for $NO_x$ emission reduction. The electronic control unit 48 is programmed to control the flow of recirculated exhaust gas as a function of engine operating conditions. For example, if the oxygen sensor 50 indicates an oxygen deficiency at the intake manifold 24, i.e., the amount of EGR flow is proportionately too high, the amount of recirculated exhaust gas may be reduced by closing the valve 52 or reducing the flow of hydraulic fluid to the hydraulically-driven turbine 60 of the EGR pump 54.

The turbocharger 12 will generally not be hydraulically assisted during steady-state operation, i.e., the fluid flow control valve 46 regulating the flow of pressurized fluid to the hydraulically-driven turbine 32 of the turbocharger will be closed. Under certain operating conditions, such as peak torque demand, it is desirable to provide EGR flow and additional air flow. Under such a condition, the fluid control valve 46 provides flow to both the turbine stage 60 of the EGR pump 54 and the hydraulically-assisted turbine stage 32 of the turbocharger 12. During engine transients, hydraulic energy is diverted away from the EGR pump 54 to the hydraulically-driven turbocharger turbine 32 by the electronic control unit 48. During a transient condition, the flow of pressurized hydraulic fluid to the hydraulically-turbocharged turbine 32 will increase the power provided to the compressor stage 14 of the turbocharger 12, and thereby increase air flow and lower smoke and particulate emissions during the transient condition. Also, diverting hydraulic energy from the exhaust gas recirculation pump 54 to the turbocharger 12 will reduce exhaust gas recirculation during transients where exhaust gas recirculation is undesirable. To insure that the flow of recirculated exhaust gas is turned off quickly before a transient, the fast-closing valve 52 may also be used to interrupt the flow of recirculated exhaust gas to the intake manifold 24.

Although the present invention is described in terms of preferred exemplary embodiments, those skilled in the art will recognize that changes in the construction, operating control parameters, and specific arrangement of the air intake, exhaust and exhaust gas recirculation system embodying the present invention may be made, consistent with the specifically stated functional requirements, without departing from the spirit of the invention. Such changes are intended to fall within the scope of the following claims. Other aspects, features, and advantages of the present invention may be obtained from a study of this disclosure and drawings, along with the appended claims.

What is claimed is:

1. An exhaust gas recirculation system for an engine having an intake manifold and an exhaust duct, comprising:

an exhaust gas recirculation pump having a compressor stage in fluid communication with said exhaust duct and with said intake manifold of the engine whereby said compressor stage is adapted to draw exhaust gas from said exhaust duct, compress said drawn exhaust gas, and discharge the compressed exhaust gas into a passageway communicating said compressor stage with said intake manifold, and a hydraulically-driven turbine mechanically connected to said compressor stage and in controlled fluid communication with a source of pressurized fluid; and a gas flow control valve disposed in said passageway communicating said compressor stage with said intake manifold of the engine, said gas flow control valve being adapted to control the flow of compressed gas from said compressor stage to said intake manifold.

2. An exhaust gas recirculation system, as set forth in claim 1, wherein said system includes a heat exchanger in fluid communication with said compressor stage of the exhaust gas recirculation pump.

3. An exhaust gas recirculation system, as set forth in claim 1, wherein said exhaust duct of the engine comprises an exhaust manifold.

4. An exhaust gas recirculation system, as set forth in claim 1, wherein said engine includes a turbocharger having a turbine exhaust port and said exhaust duct of the engine comprises a duct in direct communication with said turbine exhaust port of the turbocharger.

5. An exhaust gas recirculation system, as set forth in claim 1, wherein said engine includes at least one sensor adapted to measure an operational characteristic of the engine and an electronic control unit in electrical communication with said gas flow control valve and with said sensor, said electronic control unit being adapted to control the opening and closing of said gas flow control valve in response to receiving electrical signals having respective predefined values from said sensor.

6. An exhaust gas recirculation system, as set forth in claim 5, wherein said at least one sensor includes an oxygen sensor disposed in fluid communication with said intake manifold of the engine.

7. An exhaust gas recirculation system, as set forth in claim 5, wherein said source of pressurized fluid includes a hydraulic pump and a hydraulic flow control valve interposed between the hydraulic pump and said hydraulically-driven turbine and in electrical communication with said electronic control unit.

8. An air intake, exhaust and exhaust gas recirculation system for an engine having intake and exhaust manifolds, comprising:

a turbocharger having a compressor stage with an inlet port in fluid communication with a source of intake air and a discharge port in fluid communication with the intake manifold of said engine, a gas-driven turbine mechanically connected to said turbocharger compressor stage and having an inlet port in fluid communication with the exhaust manifold of said engine and a discharge port in fluid communication with an exhaust duct, and a hydraulically-driven turbine mechanically connected to said turbocharger compressor and having an inlet port in fluid communication with a controlled source of pressurized fluid;

an exhaust gas recirculation pump having a compressor stage in fluid communication with the exhaust manifold and with the intake manifold of said engine whereby said exhaust gas recirculation pump compressor stage is adapted to draw exhaust gas from said exhaust manifold, compress said drawn exhaust gas, and discharge the compressed exhaust gas into a passageway communicating said recirculation pump compressor stage with said intake manifold of the engine, and a hydraulically-driven turbine mechanically connected to said recirculation pump compressor stage and having an inlet port in controlled fluid communication with a source of pressurized fluid; and a gas flow control valve disposed in said passageway communicating said recirculation pump compressor stage with said intake manifold of the engine said gas flow control valve being adapted to control the flow of compressed gas from said recirculation pump compressor stage to said intake manifold.

9. An air intake, exhaust and exhaust gas recirculation system, as set forth in claim 8, wherein said system includes a heat exchanger disposed in fluid communication with said recirculation pump compressor stage and said intake manifold of the engine.

10. An air intake, exhaust and exhaust gas recirculation system, as set forth in claim 8, wherein said compressor stage of the exhaust gas recirculation pump is in fluid communication with said exhaust manifold of the engine by way of connection with the discharge port of said turbine of the turbocharger.

11. An air intake, exhaust and exhaust gas recirculation system, as set forth in claim 10, wherein said engine includes at least one sensor adapted to measure an operational characteristic of the engine and an electronic control unit in electrical communication with said gas flow control valve and with said sensor, said electronic control unit being adapted to control the opening and closing of said gas flow control valve in response to receiving electrical signals having respective predefined values from said sensor.

12. An air intake, exhaust and exhaust gas recirculation system, as set forth in claim 11, wherein said at least one sensor includes an oxygen sensor disposed in communication with said engine intake manifold.

13. An air intake, exhaust and exhaust gas recirculation system, as set forth in claim 11, wherein said controlled source of pressurized fluid for the hydraulically-driven turbine of said turbocharger includes a hydraulic pump and said system includes a hydraulic flow control valve interposed between the hydraulic pump and said hydraulically-driven turbocharger turbine and in electrical communication with said electronic control unit, and said controlled source of pressurized fluid for the hydraulically driven turbine of said exhaust gas recirculation pump includes a hydraulic flow control valve interposed between said hydraulic pump and said hydraulically-driven recirculation pump turbine and in electrical communication with said electronic control unit.

* * * * *